United States Patent [19]

Worzala, Jr.

[11] Patent Number: 4,726,561

[45] Date of Patent: Feb. 23, 1988

[54] CONCRETE INSERT APPARATUS

[76] Inventor: Edward Worzala, Jr., 4050 Pack River Rd., Sandpoint, Id. 83864

[21] Appl. No.: 907,461

[22] Filed: Sep. 15, 1986

[51] Int. Cl.[4] ..... B28B 23/00; E04B 1/41

[52] U.S. Cl. ..... 249/61; 52/125.5; 52/701; 249/62; 249/91; 249/219 R; 264/35

[58] Field of Search ..... 249/61, 62, 86, 91, 249/93, 94, 96, 97, 219 R; 264/35; 52/125.4, 125.5, 701

[56] References Cited

U.S. PATENT DOCUMENTS

| | | | |
|---|---|---|---|
| 1,157,895 | 10/1915 | Murphy et al. | 52/699 |
| 2,108,107 | 2/1938 | De Wees | 52/701 |
| 3,632,724 | 1/1972 | Hilgeman, Jr. | 264/228 |
| 3,685,782 | 8/1972 | Kowell | 249/86 |
| 3,764,066 | 10/1973 | Kowell | 238/84 |
| 3,889,916 | 6/1975 | Ilukowicz | 249/59 |
| 4,084,780 | 4/1978 | Mess | 249/59 |
| 4,211,048 | 7/1980 | Naka | 52/700 |

FOREIGN PATENT DOCUMENTS

| | | | |
|---|---|---|---|
| 307657 | 1/1969 | Sweden | 52/701 |
| 374536 | 6/1932 | United Kingdom | 52/701 |
| 1130884 | 10/1968 | United Kingdom | 52/701 |

*Primary Examiner*—Jay H. Woo
*Assistant Examiner*—James C. Housel
*Attorney, Agent, or Firm*—David R. Price

[57] ABSTRACT

A concrete insert apparatus comprising an insert adapted to be embedded in concrete and having therein an internally threaded bore, a nail including a head end received in the bore and a pointed end extending outwardly of the bore, and wax surrounding the head end of the nail within the bore so as to removably secure the nail within the bore, the wax being removable from the bore with the nail in response to pulling of the nail from the bore.

4 Claims, 7 Drawing Figures

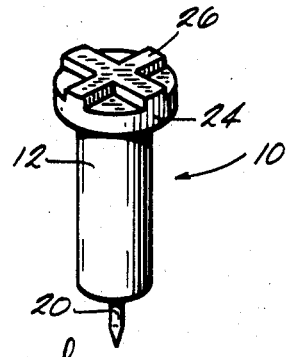
Fig. 1
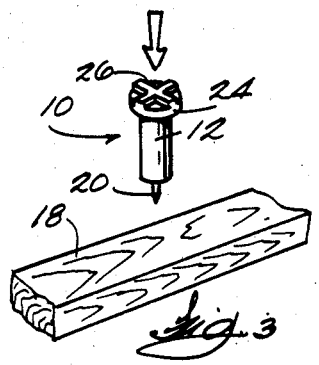
Fig. 3
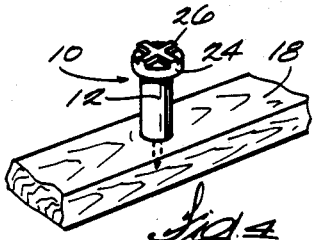
Fig. 4
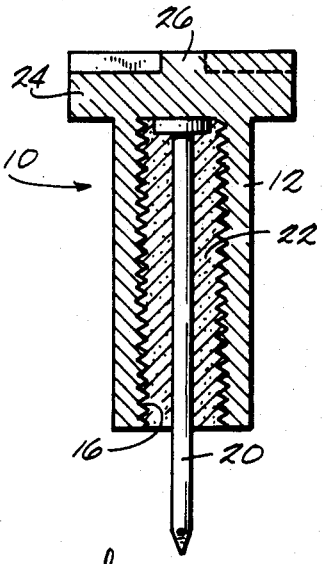
Fig. 2.
Fig. 5
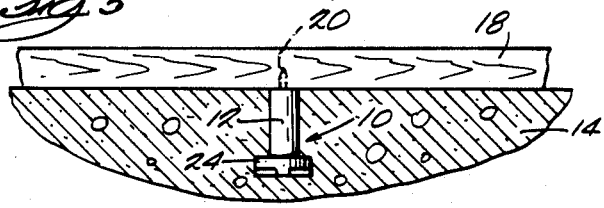
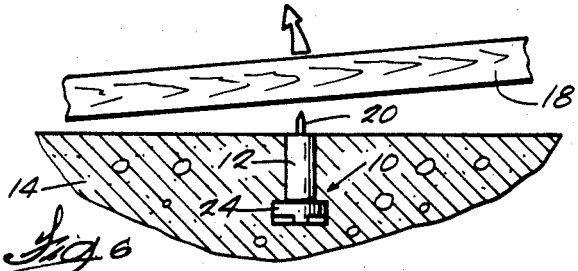
Fig. 6
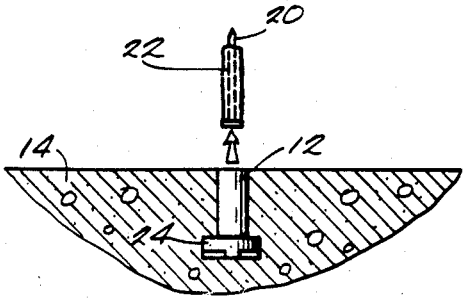
Fig. 7

CONCRETE INSERT APPARATUS

BACKGROUND OF THE INVENTION

The invention relates to concrete inserts, ie., to apparatus which are embedded in concrete when it is poured and which, after the concrete hardens, provide a bore in the concrete for receiving a fastener such as a bolt or screw.

U.S. Pat. No. 3,685,783 discloses an anchor or insert having an internally threaded bore which receives an externally threaded dowel. The dowel is connected to a board which forms a part of a concrete mold form. When the board is removed from hardened concrete, the dowel is broken, leaving a portion of the dowel in the bore. This portion must be removed from the insert before a bolt or screw can be threaded into the bore.

U.S. Pat. No. 1,045,562 discloses a concrete insert which is nailed to a board, with the nails being secured in notches on the outside of the insert. When the board is removed from hardened concrete, the tips of the nails, which extend from the concrete, are sawed off or bent over.

Attention is also directed to the following U.S. patents:

| | | |
|---|---|---|
| Hilgeman | 3,632,724 | 1/4/72 |
| Naka | 4,211,048 | 7/8/80 |
| Ilukowicz | 3,889,916 | 6/17/75 |
| Kowell | 3,764,066 | 10/9/73 |
| Kowell | 3,685,782 | 8/22/72 |
| Murphy, et al. | 1,157,895 | 10/26/15 |
| Mess | 4,084,780 | 4/18/78 |

SUMMARY OF THE INVENTION

The invention provides a method and apparatus utilizing a conventional concrete insert having therein a bore, preferably an internally threaded bore, adapted to receive a fastening device such as a bolt or screw.

More particularly, the invention provides a concrete insert apparatus comprising a concrete insert having therein an internally threaded bore adapted to receive an externally threaded member such as a bolt or screw. The apparatus also comprises a nail having its head end received in the bore and its pointed end extending outwardly of the bore. The apparatus further comprises wax surrounding the head end of the nail within the bore so as to removably secure the nail within the bore. The wax is removable from the bore with the nail when the nail is pulled from the bore. Preferably, the insert includes grooves or flanges for preventing the insert from rotating in the concrete or from being pulled from the concrete.

The invention also provides a method for locating a concrete insert in concrete. The method comprises the steps of providing a concrete insert as described above and providing a nail and wax. The method also comprises the steps of locating the head of the nail in the bore of the concrete insert with the pointed end of the nail extending outwardly of the bore, and pouring liquid wax into the bore so that the wax hardens and removably secures the nail within the bore. The method further comprises the steps of nailing the insert and nail into a mold form, pouring concrete adjacent the mold form, removing the mold form from the hardened concrete, and removing the nail and wax from the insert.

The wax serves three purposes: It secures the nail within the bore, it prevents liquid concrete from entering the bore, and, once the nail is removed from the insert, the remaining wax protects the interior of the insert and acts as a lubricant facilitating threading of a bolt into the bore. The wax is also very inexpensive and a simple means of securing the nail in the bore.

The nail provides at least two advantages. First, it securely fastens the insert to the mold form while doing minimal damage to the mold form. Second, it is easily detachable from the mold form. In fact, the nail is detached from the mold form simply by removing the mold form from the concrete.

The insert can be sold with the nail and wax in place so that all the user has to do is nail the insert onto the mold form before pouring the concrete and remove the nail and wax after the concrete has set.

Other features of the invention will become apparent to those skilled in the art upon review of the following detailed description, claims and drawings.

DESCRIPTION OF THE DRAWINGS

FIG. 1 is a perspective view of a concrete insert apparatus embodying the invention.

FIG. 2 is a vertical cross-sectional view of the apparatus.

FIGS. 3 and 4 show the apparatus being nailed to a concrete mold form.

FIG. 5 shows concrete poured adjacent the mold form and surrounding the insert.

FIG. 6 shows the mold form being removed from the harded concrete.

FIG. 7 shows the nail and wax being removed from the insert.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A concrete insert apparatus 10 embodying the invention is illustrated in FIGS. 1 and 2. The apparatus 10 comprises an insert 12 adapted to be embedded in concrete 14 and having therein a bore 16 adapted to receive a fastener means (not shown). Preferably, the bore 16 is internally threaded and is adapted to receive an externally threaded member such a screw or a bolt.

The apparatus 10 also comprises a member having a first portion received in the bore 16 and a second portion extending outwardly of the bore and adapted to be connected to a concrete mold form 18. In the preferred embodiment, the member is a conventional nail 20 having a head end received in the bore 16 and a pointed end extending outwardly of the bore 16. Preferably, the head of the nail 20 rests against the bottom of the bore 16. The pointed end of the nail 20 can be nailed into the mold form 18. Alternatively, other types of members which are connected to mold forms in other ways can be used.

The apparatus 10 further comprises means 22 received in the bore 16 for removably securing the first portion of the member, i.e, the head end of the nail 20, within the bore 16, the means 22 being removable from the bore 16 with the nail 20 in response to pulling of the nail 20 from the bore 16. While various suitable means 22 can be employed, in the preferred embodiment, the securing means 22 includes a substance which is a liquid at high temperatures (above normal outdoor temperatures), which hardens at low temperatures, and which is nonresilient and deformable when hardened. Preferably, the substance is wax. Liquid wax is poured into the bore 16 so that when it hardens it surrounds the head end of the nail 20 to removably secure the nail 20 within the bore 16.

In the preferred embodiment, the closed end of the insert 12 has an annular, outwardly extending flange 24. The end surface of the insert 12 includes a raised portion 26, preferably X-shaped. The flange 24 prevents the insert 12 from being pulled from the concrete 14. The raised portion 26 prevents the insert 12 from rotating within the concrete 14 when a bolt is threaded into the insert 12.

The apparatus 10 is used as follows. As shown in FIGS. 3 and 4, the insert 12, with the nail 20 and wax within the bore 16, is nailed to the mold form 18. Because the nail 20 rests against the bottom of the bore 16, the insert 12 and nail 20 can be nailed to the mold form 18 by striking the end surface of the insert 12. Next, as shown in FIG. 5, concrete 14 is poured adjacent the mold form 18 and around the insert 12. When the concrete 14 hardens, the mold form 18 is removed as shown in FIG. 6. When the mold form 18 is pulled from the concrete 14, the nail 20 and wax remain in place within the bore 16. Finally, as shown in FIG. 7, the nail 20 is pulled from the bore 16. Most of the wax will come out of the bore 16 with the nail 20. The remaining wax protects the interior of the bore 16 and acts as a lubricant facilitating threading of a screw or bolt into the bore 16.

Various features and advantages of the invention are set forth in the following claims.

I claim:

1. A concrete insert apparatus comprising an insert adapted to be embedded in concrete and having therein a bore adapted to receive a fastener means, a member having a first portion received in said bore and a second portion extending outwardly of said bore and adapted to be connected to a mold form, and wax surrounding said first portion of said member within said bore for removably securing said first portion of said member within said bore, said wax being removable from said bore with said member in response to pulling of said member from said bore.

2. An apparatus as set forth in claim 1 wherein said bore is internally threaded and is adapted to receive an externally threaded member.

3. An apparatus as set forth in claim 1 wherein said member is a nail including a head end received in said bore and a pointed end extending outwardly of said bore.

4. A concrete insert apparatus comprising an insert adapted to be embedded in concrete and having therein an internally threaded bore adapted to receive an externally threaded fastening means, a nail including a head end received in said bore and a pointed end extending outwardly of said bore, and wax surrounding said head end of said nail within said bore so as to removably secure said nail within said bore, said wax being removable from said bore with said nail in response to pulling of said nail from said bore.

* * * * *